US005834716A

United States Patent [19]

Lee

[11] Patent Number: 5,834,716

[45] **Date of Patent: *Nov. 10, 1998**

[54] FOUR POSITION TWO DOME SWITCH

[75] Inventor: James Sungioun Lee, Niles, Ohio

[73] Assignee: Packard Hughes Interconnect Company, Irvine, Calif.

[ * ] Notice: The term of this patent shall not extend beyond the expiration date of Pat. No. 5,719,361.

[21] Appl. No.: 694,585

[22] Filed: Aug. 9, 1996

[51] Int. Cl.[6] ..... H01H 9/26; H01H 9/00; H01H 1/10

[52] U.S. Cl. ..... 200/5 R; 200/1 B; 200/517; 200/339

[58] Field of Search ..... 200/1 B, 5 A, 200/5 R, 275–277.2, 339, 512–517, 557

[56] References Cited

U.S. PATENT DOCUMENTS

| | | | |
|---|---|---|---|
| 4,081,632 | 3/1978 | Schaffeler | 200/6 BB |
| 5,412,164 | 5/1995 | Conway et al. | 200/1 B |
| 5,426,275 | 6/1995 | Maeda et al. | 200/553 |
| 5,430,261 | 7/1995 | Malone | 200/1 B |
| 5,510,583 | 4/1996 | Pescetto | 200/1 B |
| 5,559,311 | 9/1996 | Gorbatoff | 200/513 |
| 5,622,254 | 4/1997 | Lee | 200/557 |
| 5,719,361 | 2/1998 | Lee | 200/1 B |

*Primary Examiner*—Wynn Wood Coggins
*Assistant Examiner*—Michael J. Hayes
*Attorney, Agent, or Firm*—Cary W. Brooks

[57] ABSTRACT

The invention includes a mechanism for multi-dome dual detent switches having at least a first and second collapsible dome structure. An elongated action bar extends across and bridges the first and second collapsible dome members. The action bar has a top surface and a bottom surface. A notch is formed in the top surface closer to one of the dome structures. A keycap positioned for pivotal movement between a first and second forward position, and a first and second rear position. The keycap includes an engagement bar extending downwardly near one end and positioned to be received in the notch formed in the top surface of the action bar.

2 Claims, 2 Drawing Sheets

FOUR POSITION TWO DOME SWITCH

FIELD OF THE INVENTION

This invention relates to switches utilizing collapsible domes.

BACKGROUND OF THE INVENTION

A variety of switches using collapsible domes are known. Maeda et al, U.S. Pat. No. 5,426,275, issued Jun. 20, 1995, the disclosure of which is hereby incorporated by reference, describes a seesaw switch including an action bar bridging first and second elastic click members. The elastic click members have flat tops and carry a movable contact positioned under the tops and over a fixed contact. A keycap is pivotably positioned over the action bar and includes a first sharp projection contacting the action bar near the first elastic click member, and a second sharp projection contacting the action bar near the second elastic click member. The action bar may be pivoted a first angular amount in a clockwise direction, causing the action bar to rotate with respect to the second elastic member to buckle the first click member. Further pivoting the keycap in a clockwise direction causes the action bar to rotate with respect to the buckled first elastic member, thereby buckling the second elastic click member. Similarly when the action bar is pivoted a first amount in a counterclockwise direction, the second click member is buckled, and further pivoting the action bar subsequently causes the first elastic click member to buckle. Thus, the system provides a four-position switch using two elastic click members.

However, it has been discovered that such a system has a variety of disadvantages. Asymmetric loading of the sharp projections of the keycap induces tilting of the action bar in multiple planes. Further, the action bar is susceptible to linear movement with respect to the two elastic click members. As a result of these susceptibilities, the switch system is subject to variable dual detent feel during its operation life. Further, a reduction in the difference in the magnitude of the force required to collapse the first and second elastic click members, or possibly complete failure of the switch, may result from substantial movement of the action bar.

The present invention provides advantages and alternative to the prior art.

SUMMARY OF THE INVENTION

The invention includes a mechanism for multi-dome dual detent switches having at least a first and second collapsible dome structure. The dome structures have a relatively thick annular ring member and a center membrane underneath the annular ring member. A wall extends downward from the annular ring to complete the dome structure. The annular ring and membrane defining a depression in the top surface of the dome. An elongated action bar extends across and bridges the first and second collapsible dome members. The action bar has a top surface and a bottom surface. A notch is formed in the top surface closer to one of the dome structures. A keycap positioned for pivotal movement between a first and second forward position, and a first and second rear position. The keycap includes an engagement bar extending downwardly near one end of the keycap and positioned to be received in the notch formed in the top surface of the action bar.

When the keycap is rotated forward to a first position, the engagement bar forces the action bar to rotate in a direction towards the first collapsible dome structure causing the structure to collapse. Movement of the pedal still further forward causes the action bar to rotate towards the second dome member collapsing the same. The pedal may be moved to first and second backward (rear) positions to reverse the order in which the domes are collapsed.

The downwardly extending nubs from the action bar being received in the depression of the dome holds the action bar in a fixed relationship throughout the life of the switch. Likewise, the downwardly extending engagement bar of the keycap being received in the notch of the action bar fixes the location of the action bar and prevents the same from any tilting or movement due to asymmetrical loading.

These and other objects, features, and advantages of the present invention will become apparent from the following brief description of the drawings, detailed description and appended claims and drawings.

DETAILED DESCRIPTION

Figure 1:
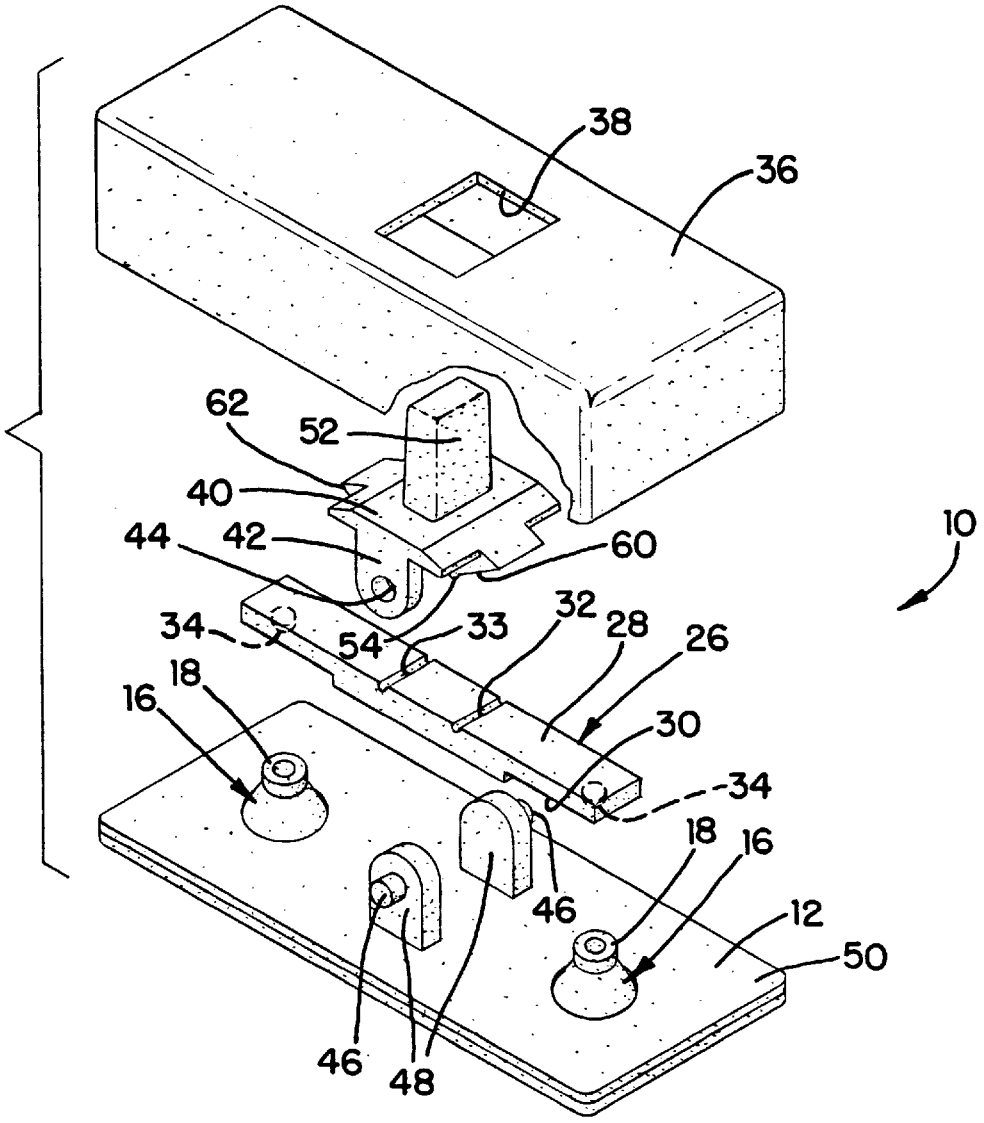
FIG. 1 illustrates an exploded view of a switch mechanism according to the present invention.
Figure 2:
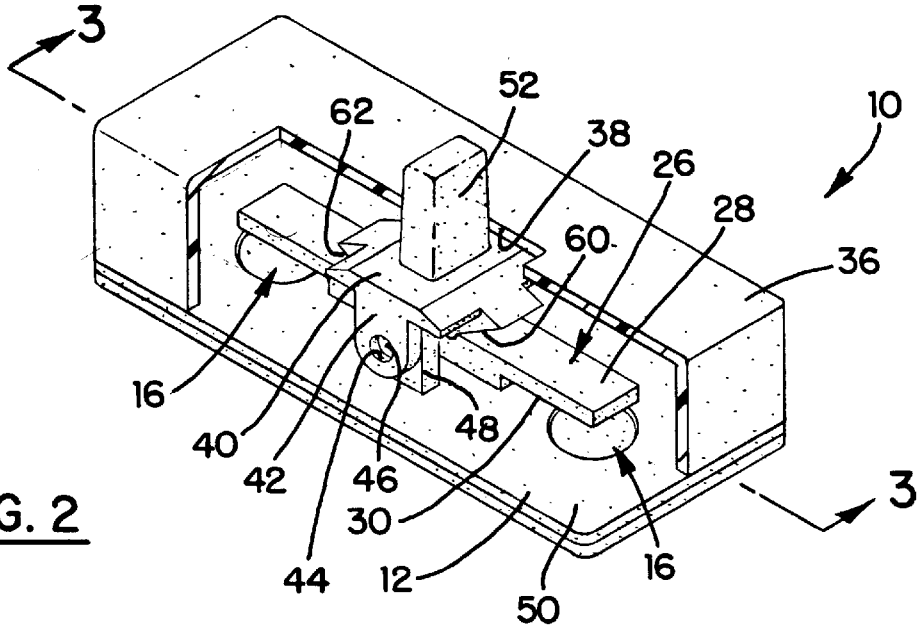
FIG. 2 is a perspective view with portions broken away of the present invention.
Figure 3:
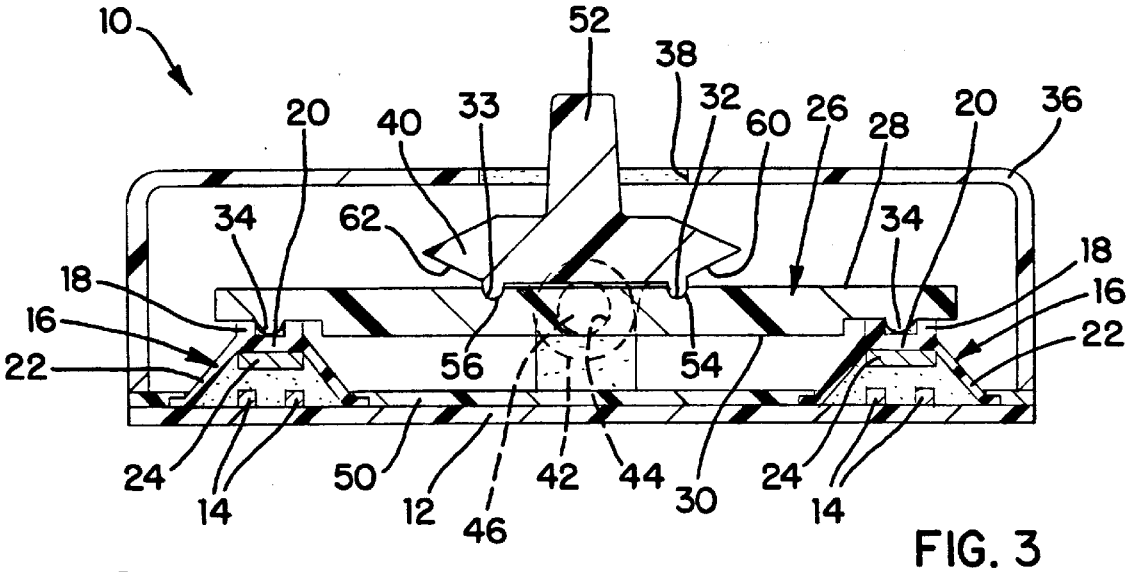
FIG. 3 is a sectional view taken along line 3—3 of FIG. 2.
Figure 4:
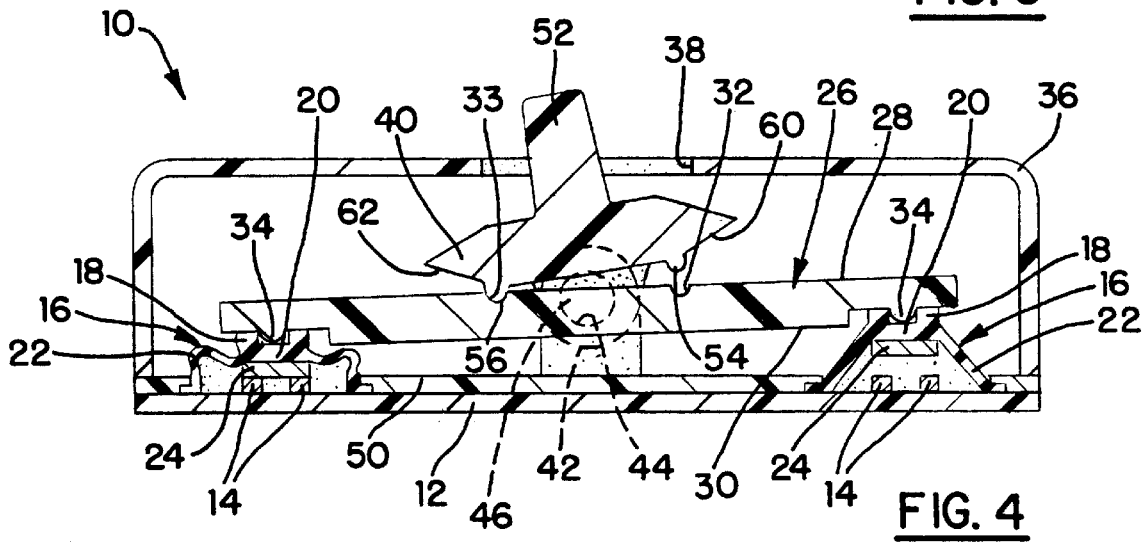
FIGS. 4 and 5 illustrate movement of the switch between first and second forward positions.
Figure 5:
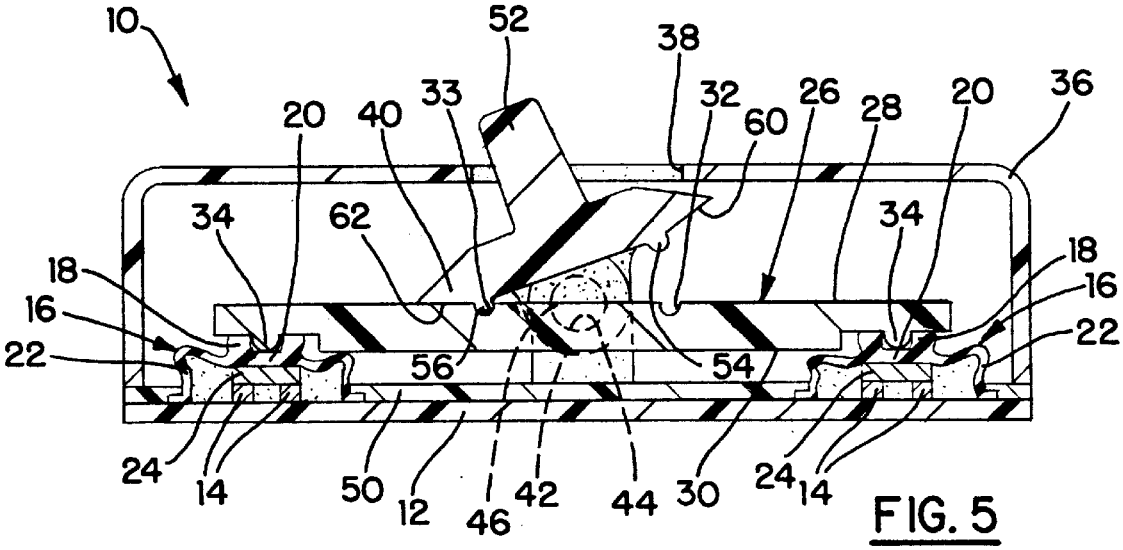

A switch 10 according to the present invention includes a first substrate 12 having a plurality of spaced apart electrical traces 14 for an electrical circuit. Overlying the spaced apart traces 14 is a collapsible dome structure 16. The collapsible dome structure 16 includes an upper relatively thick annular ring portion 18 and a thinner membrane 20 underlining the annular ring portion. A wall 22 extends downwardly from the upper annular ring portion to form the dome structure. Preferably, the dome structure is formed from an elastomer such as silicone. An electrically conductive pellet 24 is secured to the underside of the thin membrane portion and positioned to engage the spaced apart electrical traces 14 when the dome is collapsed thus closing an electrical circuit. As shown in FIG. 1, a switch according to the present invention includes two spaced apart dome structures 16.

An elongated action bar 26 is provided having a top surface 28 and a bottom surface 30. The action bar extends across and bridges the two spaced apart dome structures 16. A pair of elongated notches 32, 33 are formed in the top surface 28 of the action bar and are spaced from the midpoint of the action bar and near a respective dome structure. A semi-spherical engagement nub 34 may extend downwardly from the bottom surface of the action bar at a location near each end. The engagement nub is constructed and arranged to be frictionally received inside the recess defined by the annular ring 18 of the dome structure.

A housing 36 overlies the substrate, collapsible domes and action bar. The housing has an opening 38 in an upper surface thereof for receiving a pivotal switch pedal. The pedal includes a body portion 40 and legs 42 extending downward from both sides of the body portion and having a hole 44 formed therein for receiving a pivot rod 46 extending from a mount 48 connected to a cover layer 50 overlying the lower substrate 12. A pedestal 52 extends upwardly from the body portion 40 for movement of the switch by an operator. A front engagement bar 54 is located closer to one end of the body portion and a rear engagement bar 56 is located closer to the other end of the body portion. The engagement bars 54, 56 are located and constructed and arranged to be received respectively in one of the notches 32, 33 formed in the top surface of the action bar.

Preferably, the pedal includes flat secondary engagement surfaces 60, 62 extending a distance from each engagement bar 54, 56 and constructed to engage the action bar when the pedal is moved further to the second position wherein both domes are collapsed. The flat secondary engagement surface acts as a stop.

The switch system according to the present invention can be utilized to operate a variety of devices including, such as a automotive power window system. In such a system, the operator pushes the pedal or keycap forward to a first activation position wherein the front (first) engagement bar 56 pushes down on the activation bar causing it to pivot towards a first dome structure and collapsing the first dome structure. In the first activation position an operator can raise the power window selective amounts as desired. As the operator pushes the keycap still further forward using more force to a second activation position, the engagement bar 56 and/or the flat surface 62 applies pressure to the activation bar causing the activation bar to pivot towards the second dome structure and collapsing the second dome structure while the first dome structure remains collapsed. In the second activation position, both dome structures are collapsed each closing a circuit and sending a signal to a device such as a CPU which then activates a motor to cause the window to go up automatically on an express basis until the window is closed. The CPU detects the order in which the domes are collapsed and activates the motor accordingly. Likewise, the operator can move the keycap backwards to a third position in which the rear (second) engagement bar 54 engages the second action bar causing the second dome structure to collapse. In the third position the operator can move the window down selectively as desired. When the operator moves the keycap still further backwards, additional force is applied by the engagement bar 54 and/or flat surface 60 to the second activation bar causing the activation bar to pivot towards the first dome structure and collapsing the same. In this fourth activation position, both the first and second dome structures are collapsed closing associated circuits underneath and sending a signal to a device such as a CPU. Again, the CPU detected the order in which the domes are collapsed and then activates a motor causing the window to move down automatically on an express basis until it is completely opened. In both cases, the flat surfaces 60, 62 spread the application force further across the action bars length improving the ability to collapse both domes at the same time.

As can be appreciated, the present invention eliminates unwanted tilting of the action bar due to asymmetrical loading in a four-position two-dome switch.

What is claimed is:

1. An electrical switch comprising a substrate having two sets of spaced apart electrical traces, a collapsible dome structure overlying an associated set of spaced apart electrical traces, said collapsible dome structure including an upper annular ring and a thin membrane underlining that annular ring, a wall extending downwardly from the annular ring, an electrically conductive element secured to an underface of the membrane and constructed and arranged to engage the spaced apart electrical traces upon collapsible dome structure, and wherein said annular ring and said thin membrane defined a depression in the top of the dome structure, an elongated action bar overlying the pair of dome structures, said action bar having at top surface and a bottom surface, and a first and second elongated notch formed in the top surface of the action bar each at a location spaced from the midpoint of the action bar and each notch running perpendicularly to the longitudinal axis of the action bar and running the width of the action bar, a first engagement nub extending downwardly from the bottom surface of the action bar and position to be frictionally received in the recess formed in the top of the first dome structure and a second engagement nub extending downwardly from the bottom face of the action bar and constructed and arranged to be frictionally received in the recess formed in the top of the second dome structure, a keycap have a body portion and first and second elongated engagement bars extending downward from the body portion and position to be received in a respective elongated notch formed in the top surface of the action bar, said keycap being movable in a first direction to a first activation position causing the action bar to pivot towards the first dome structure and collapsing the first dome structure first, and said keycap being movable further in said first direction to a second activation position causing the action bar to pivot towards to second dome structure and collapsing the second dome structure while said first dome remains collapsed, said keycap being movable in a second direction to a third activation position causing the action bar to be pivoted towards the second dome structure and collapsing the second dome structure first, and said keycap being movable further in said second direction to a forth activation position causing the action bar to pivot towards the first dome structure and collapsing the first dome structure second while said second dome structure remains collapsed.

2. A switch as set forth in claim 1 wherein said keycap further includes flat secondary engagement surfaces respectively extending from each elongated engagement bar a distance and constructed to engage the top surface of the action bar upon movement of the keycap to the second and fourth activation positions respectively.

* * * * *